United States Patent [19]

Jasper, Jr. et al.

[11] Patent Number: 4,621,218

[45] Date of Patent: Nov. 4, 1986

[54] TRANSVERSE FIELD INTERACTION MULTIBEAM AMPLIFIER

[75] Inventors: Louis J. Jasper, Jr., Ocean; Charles M. DeSantis; James F. Baxendale, both of Neptune, all of N.J.

[73] Assignee: The United States of America as represented by the Secretary of the Army, Washington, D.C.

[21] Appl. No.: 640,184

[22] Filed: Jul. 2, 1984

[51] Int. Cl.[4] ..... H01J 25/34

[52] U.S. Cl. ..... 315/3.6; 315/5.14; 315/5.16

[58] Field of Search ..... 315/5.14, 5.16, 5.36, 315/5.37, 3.6, 5.29; 330/43

[56] References Cited

U.S. PATENT DOCUMENTS

| | | | |
|---|---|---|---|
| 2,721,957 | 10/1955 | Neher | 315/5.14 X |
| 2,870,374 | 1/1959 | Papp | 315/5.16 X |
| 2,932,762 | 4/1960 | Geppert | 315/5.29 |
| 3,107,313 | 10/1963 | Hechtel | 315/5.29 X |
| 3,237,047 | 2/1966 | Webster | 315/5.29 |
| 3,278,793 | 10/1966 | Dehn | 315/5.14 |
| 3,760,219 | 9/1973 | DeSantis et al. | 315/3.5 |
| 4,559,476 | 12/1985 | Hoover | 315/5.16 |

OTHER PUBLICATIONS

U.S. Army ECOM Technical Report, "High Power Traveling Wave Multiple Beam Klystron", Branch, et al., Oct. 1967, D.A. 28-043AMC-00007(e).-Discloses a Multi-Beam Klystron.

*Primary Examiner*—Saxfield Chatmon

*Attorney, Agent, or Firm*—Sheldon Kanars; Jeremiah G. Murray; Edward Goldberg

[57] ABSTRACT

A transverse field interaction multi-beam amplifier device comprising a structure having, for example, a plurality of discrete cathodes cylindrically located in succession along a central axis of RF propagation. In registration with the cathodes are a respective number of annular collectors located within an outer cylinder which also acts as the structure housing. Intermediate the cathodes and collectors are two additional coaxial cylinders, one having a relatively smaller diameter than the other, with the smaller diameter cylinder including respective number of discrete grids, while the larger cylinder comprises a structure preferably having a rippled or undulating slow wave wall surface and a respective number of annular slots formed therein. The cathodes emit radial beams of electrons which pass through and are bunched by the grids and then accelerated by the slots to the collectors while interacting with and being modulated by an input RF beam propagating along the central axis of the coaxial structure between a first pair of cylinder walls including the grids and cathodes and inducing an output beam in a second pair of cylinder walls including the slots in the slow wave wall surface and the grids.

19 Claims, 9 Drawing Figures

RF OUT
Z AXIS
RF IN
a>b
COLLECTOR
CATHODE
GRID

TRANSVERSE FIELD INTERACTION MULTIBEAM AMPLIFIER

The invention described herein may be manufactured and used by or for the Government for governmental purposes without the payment of any royalties thereon or therefor.

CROSS REFERENCE TO RELATED APPLICATION

This application is related to application Ser. No. 638,183, entitled, "Broadband Transverse Field Interaction Multibeam Amplifier", filed in the name of Lewis J. Jasper, et al. on Aug. 6, 1984.

BACKGROUND OF THE INVENTION

This invention relates generally to high frequency amplification devices and more particularly to such a device where amplification results from the interaction of electron beams with RF fields in a wave propagating transmission line.

Interactive types of devices for amplification of RF signals at microwave frequencies are well known. The traveling wave tube constitutes such a device and is one in which a longitudinal electron beam interacts continuously with the RF field of a wave traveling along a wave propagating slow wave circuit structure such as a helix. Additionally, means are provided to couple an external radio frequency (RF) signal to and from the slow wave circuit structure. The velocity of the electron stream, moreover, is adjusted to be approximately the same as the phase velocity of the wave on the helix. When an RF wave is launched on the slow wave circuit, i.e. the helix, the longitudinal component of the field interacts with the electrons traveling along in approximate synchronism with it. Some electrons will be accelerated while others will be decelerated which results in a progressive rearrangement in phase of the electrons with respect to the wave. The electron stream thus modulated in turn induces additional waves on the helix. This process of mutual interaction continues along the length of the helix with the net result being that direct current energy is given up by the electron in the stream to the circuit as radio frequency energy and the RF signal is thus amplified.

One example of a traveling wave tube is shown and described in U.S. Pat. No. 3,760,219, issued to Charles M. DeSantis, et al. one of the present inventors, on Sept. 18, 1973, and discloses, among other things, a traveling wave tube having a control grid for effecting klystron type of bunching of the electron stream. Another known type of microwave amplification device, which employs a transverse field interaction for its operation, comprises a multibeam klystron which has been disclosed and described, for example, in a U.S. Army ECOM technical report entitled, "High Power Traveling Wave Multiple Beam Klystron", Branch, et al. ECOM-007F technical report, October, 1967, D.A. 28-043AMC-00007(e). There two and three waveguide multiple beam klystron structures are shown and described that produce megawatts of power over a wide frequency band and at substantially lower beam voltages relative to single beam conventional klystrons. The multiple beam klystron utilizes a multiplicity of separate and distinct electron beams that are arranged to interact with RF fields in at least two or more waveguides that are periodically loaded with capacitive gaps consisting of both buncher and catcher type gaps. The buncher gaps are driven by a transverse RF wave traveling in one waveguide where the wave in turn modulates each of the beams. The beams then travel across the buncher gaps in the other waveguide where an amplified RF wave is induced therein and which is conveyed to an output circuit.

Accordingly, it is an object of the present invention to provide an improvement in apparatus for amplifying electromagnetic waves.

It is another object of the invention to provide an improvement in apparatus for amplifying microwave signals.

It is a further object of the invention to provide an improvement in microwave amplification devices which operate on the principle of field interaction between an electron beam and an RF signal wave.

It is yet another object of the invention to provide an improvement in field interaction amplification devices which results in improved signal gain and efficiency.

SUMMARY

Briefly, the foregoing and other objects are achieved by means of a transverse field interaction multibeam amplifier device comprising a structure having, for example, a plurality of discrete cathodes cylindrically located in succession along a central axis of RF propagation. In registration with the cathodes are a respective number of annular collectors located within an outer cylinder which also acts as the structure housing. Intermediate the cathodes and collectors are two additional cylinders, one having a relatively smaller diameter than the other, with the smaller diameter cylinder including respective number of annular grids, while the larger cylinder comprises a structure preferably having a rippled or undulating slow wave wall surface and a respective number of annular slots formed therein. The cathodes emit radial beams of electrons which pass through and are bunched by the grids and then accelerated by the slots to the collectors while interacting with and being modulated by an input RF beam propagating along the central axis of the cylindrical structure between a first pair of walls including the grids and cathodes and inducing an output beam in a second pair of walls including the slots in the corrugated wall and the grids.

DESCRIPTION OF THE PREFERRED EMBODIMENTS

Figure 1:
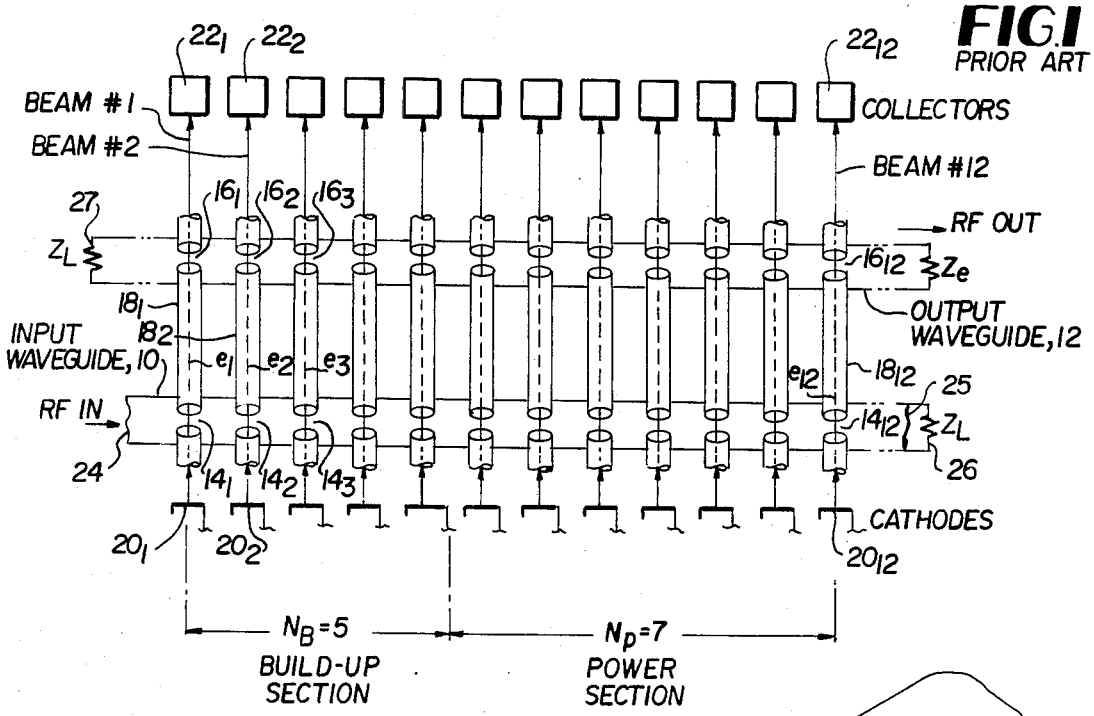
FIG.1 PRIOR ART
FIG. 1 is an electrical schematic diagram illustrative of a two waveguide traveling wave klystron which constitutes known prior art.

Referring now to the drawings and more particularly to FIG. 1, shown thereat in schematic form is a multibeam traveling wave klystron of the known prior art and which has been disclosed, for example, in the above referenced Branch, et al. publication entitled, "High Power Traveling Wave Multiple Beam Klystron", and which is intended to be helpful in understanding the principle of operation of the subject invention.

The klystron of FIG. 1 comprises a two waveguide traveling wave multiple beam klystron which utilizes a plurality of electron beams respectively generated in N=12 discrete beam sections that are configured to interact with RF fields in a pair of waveguide transmission line members 10 and 12, constituting input and output waveguides and which respectively have periodically located capacitive gaps shown by reference numerals $\mathbf{14}_1$, $\mathbf{14}_2 \ldots \mathbf{14}_{12}$ and $\mathbf{16}_1$, $\mathbf{16}_2 \ldots \mathbf{16}_{12}$. These gaps, moreover, form part of twelve transverse beam conductor elements $\mathbf{18}_1$, $\mathbf{18}_2 \ldots \mathbf{18}_{12}$ which are respectively situated intermediate cathode elements $\mathbf{20}_1$, $\mathbf{20}_2 \ldots \mathbf{20}_{12}$ and collector elements $\mathbf{22}_1$, $\mathbf{22}_2 \ldots \mathbf{22}_{12}$. Twelve beams, namely beam Nos. 1 through 12 respectively traverse the first set of gaps $\mathbf{14}_1 \ldots \mathbf{14}_{12}$, which are known as buncher gaps, and the second set of gaps $\mathbf{16}_1 \ldots \mathbf{16}_{12}$ which are known as catcher gaps. The buncher gaps, moreover, are driven by an RF input wave injected at one end 24 of the input waveguide 10. This waveguide is terminated at the other end 26 in its characteristic impedance $Z_L$ to prevent establishment of any standing waves generated by reflected energy due to impedance mismatch. A propagation phase delay occurs in the input waveguide 10 as the input wave $RF_{in}$ traverses down the waveguide from left to right and interacts sequentially with each of the buncher gaps $\mathbf{14}_1 \ldots \mathbf{14}_{12}$. Accordingly, the beam currents $e_1, e_2 \ldots e_{12}$ interacting with the input RF wave are modulated by it and thereafter traverse the catcher gaps $\mathbf{16}_1 \ldots \mathbf{16}_{12}$ and in so doing induce an output wave in the waveguide 12 which also traverses in a forward left to right direction, where it is sensed across an output impedance $Z_e$. The opposite end 27 of the output waveguide 12 is terminated in a characteristic impedance $Z_L$, again to prevent reflections and thus prevent the set up of a standing wave in the output waveguide 12.

The klystron configuration shown in FIG. 1 can further be considered to be comprised of two major parts or sections, first a build-up section $N_{b=5}$ and secondly, a power section $N_{p=7}$. The build-up section is necessary and critical because a proper build up voltage is required so that the beams $e_5$ through $e_{12}$ are properly matched to obtain the desired gain and efficiency. For the two waveguide embodiments of FIG. 1, the bandwidth improvement factor over a single beam klystron is approximately $N_B$, the number of beams in the build-up section.

The structures generating and directing the electron beams $e_1 \ldots e_{12}$ are designed to provide the highest perveance consistent with focusing and gun spacing constraints. Experimentation has revealed that at least twelve N=12 beams are required for proper beam build up for a two waveguide system. Moreover, the number of beams times the bandwidth percent must be less than 50. Although a linear configuration is shown in FIG. 1, when desirable, it can be reconfigured into a circular arrangement; however, focusing becomes relatively more difficult due to transverse components of the magnetic fields.

Figure 2:
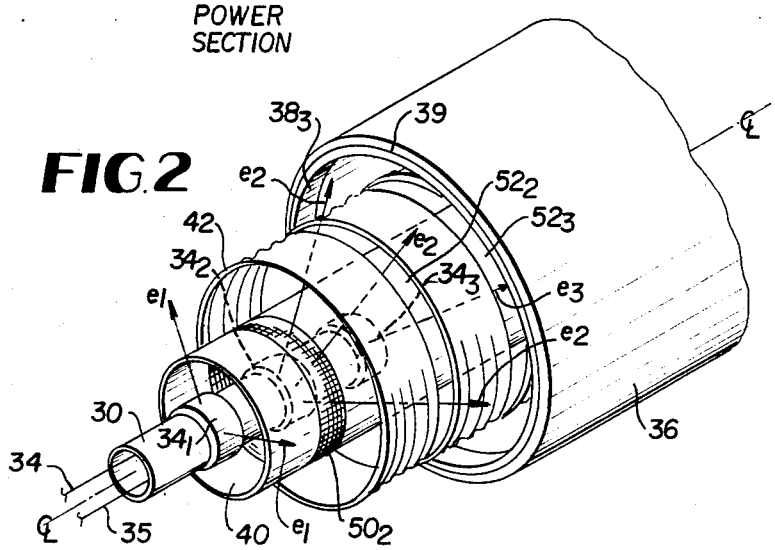
FIG. 2 is a partial perspective view illustrative of a first embodiment of the invention.
Figure 3:
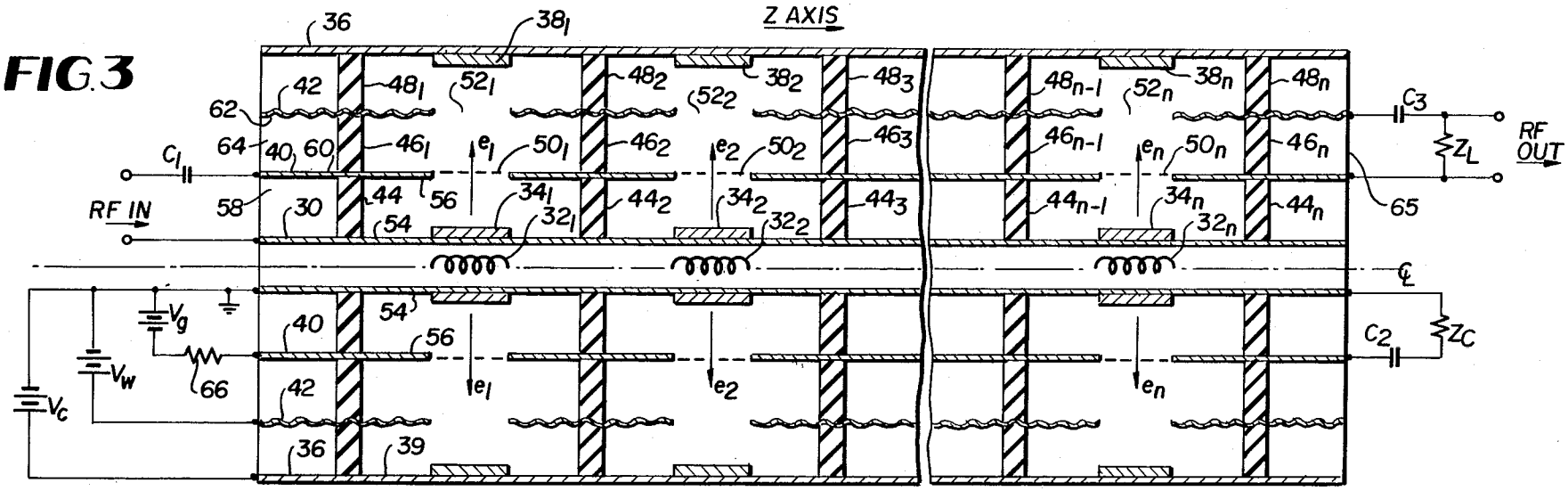
FIG. 3 is a fragmented central longitudinal sectional view of the embodiment shown in FIG. 2.

This now leads to a consideration of the subject invention which is directed to a relatively simple yet effective structure for amplifying an RF wave by the interaction of a plurality of transverse electron beams. Referring now collectively to FIGS. 2 and 3, shown therein is an improved transverse field interaction device comprised of a generally cylindrical structure wherein a discrete number of cathodes emit radial beam currents which travel outwardly to annular collectors and which interact with an RF wave propagated along the length (Z axis) of the cylindrical structure along adjacent cylindrical waveguides which include grids and slots for permitting the current beams to pass from each of the cathodes to their respective collectors.

More particularly, and as shown in FIG. 2, a relatively small innermost cylinder 30 houses a plurality of individual heater elements $\mathbf{32}_1$, $\mathbf{32}_2 \ldots \mathbf{32}_n$ (FIG. 3) and which are adapted to be preferably coupled in parallel to a pair of electrical leads 34 and 35 (FIG. 2) so that the device does not become inoperative in the event that one of the heaters fails for any reason. On the outside surface of the cylinder 30 adjacent the heaters $\mathbf{32}_1 \ldots \mathbf{32}_n$ are a like number of discrete annular cathode elements $\mathbf{34}_1$, $\mathbf{34}_2 \ldots \mathbf{34}_n$ which for purposes of illustration only have a significant thickness. An outermost cylinder 36 which acts as a housing also supports a like plurality of annular collector elements $\mathbf{38}_1$, $\mathbf{38}_2 \ldots \mathbf{38}_n$ on the inner surface 39 thereof. Intermediate the two cylinders 30 and 36 are located two other cylinders 40 and 42, the latter also being configured as a slow wave structure having rippled or undulating surfaces. The cylinders are held in place and spaced apart from each other by means of a set of dielectric spacer elements $\mathbf{44}_1 \ldots \mathbf{44}_n$, $\mathbf{46}_1 \ldots \mathbf{46}_n$, $\mathbf{48}_1 \ldots \mathbf{48}_n$ and which, when desired, can be fabricated as rods or disks. These elements also serve to dielectrically load the device. The cylinder 40, moreover, is configured to include a set of discrete annular grid elements $\mathbf{50}_1$, $\mathbf{50}_2 \ldots \mathbf{50}_n$ which are equal in number and in registration with respective cathode and collector elements. In order for electrons to pass from the cathode to collector, the corrugated cylinder 42 which acts as a slow wave structure additionally includes a like number of annular slots or apertures $\mathbf{52}_1$, $\mathbf{52}_2 \ldots \mathbf{52}_n$.

Further as shown in FIG. 3, the mutually opposing surfaces 54 and 56 of the cylinders 30 and 40 provide an input transmission line 58 in the form of an annular circular waveguide while the mutually opposing surfaces 60 and 62 of the cylinders 40 and 42 provide an output waveguide structure 64 also in the form of a circular waveguide. Thus what results is a pair of contiguous concentric annular waveguides where, for example, an input signal is shown coupled to the inner circular waveguide 58. The opposite or far end of waveguide 58 is terminated in an impedance $Z_C$ and a DC blocking capacitor $C_2$. An output signal is induced in the outer waveguide 64 and is coupled from the far end by means of sensing the signal across a load impedance $Z_L$ which is coupled across the guide together with a DC blocking capacitor $C_3$.

Further as shown in FIG. 3, in order to provide suitable bias potentials for making the device operational, a DC negative supply voltage $V_g$ is coupled to the grids $\mathbf{50}_1 \ldots \mathbf{50}_n$ located in cylinder 40 by means of a coupling resistor 66. A positive DC bias potential $V_w$ is coupled to the slow wave structure comprising the rippled waveguide 42 for providing an acceleration potential, for the electron streams $e_1 \ldots e_n$, to the slots $52_1 \ldots 52_n$ and finally, a positive DC supply voltage $V_c$ is applied to the annular collectors $38_1 \ldots 38_n$ by being coupled to the outer cylinder 36.

Figure 4:
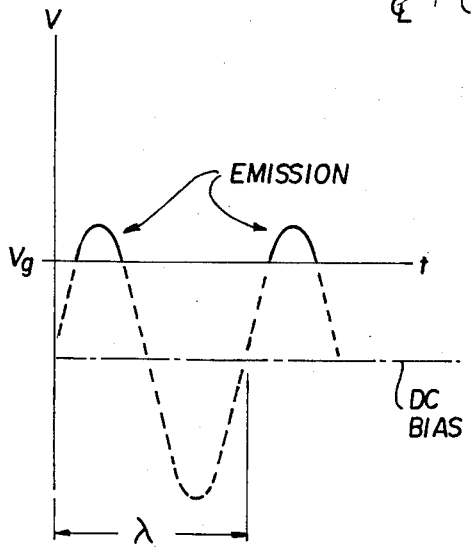
FIGS. 4 and 5 are diagrams illustrative of the operating voltage and current characteristics of a device in accordance with the subject invention.
Figure 5:
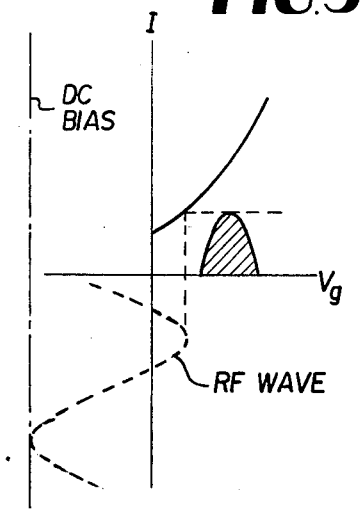

In operation, the cathodes $34_1 \ldots 34_n$ emit respective electron beams $e_1 \ldots e_n$ radially where they are controlled and accelerated by the grids and slots $50_1 \ldots 50_n$ and $52_1 \ldots 52_n$, respectively, which are located at discrete locations along the Z axis of propagation of the RF input signal $RF_{in}$ which interacts with the beams $e_1 \ldots e_n$ in sequence as it propagates and in so doing causes electron bunching as will be explained. The electron beams thus bunched pass through the slotted waveguide 64 and are collected by the collector electrodes $38_1 \ldots 38_n$ located on the outermost cylinder 36, along the Z axis. The undulating walls of the waveguide cylinder 42 are rippled for the purpose of reducing the phase velocity of an induced RF wave propagating in the waveguide 64 towards the output end 65 to the right of the configuration shown in FIG. 3. With the biases thus applied, emission past the grids occurs only when the RF positive voltage from the input signal $RF_{in}$ applied to the waveguide 58 and propagating therealong is greater than the threshold voltage required for emission. This can be understood in light of the voltage and current characteristics for the cathodes as shown in FIGS. 4 and 5. In FIG. 4 grid-to-cathode voltage for one cathode along the grid-cathode input waveguide 58 is shown as a function of time. The DC cut-off bias is shown by a broken line. FIG. 5 further indicates only that part of the traveling voltage wave which annuls the cutoff bias and permits a radially directed burst of current to flow from a local area of the cathode annulus past the grid. Thus anywhere along the waveguide 58 where the local grid potential exceeds $V_g$, there is emission. In effect, the electrons will be emitted in bunches only during the positive half cycles as the voltage maxima from the propagating RF wave successively passes the various grids $50_1 \ldots 50_n$ in sequence. Therefore, the electron beams $e_1 \ldots e_n$ are pre-bunched upon leaving grids $50_1$, $50_2 \ldots 50_n$, traversing waveguide 64 and reaching waveguide slots $52_1$, $52_2 \ldots 52_n$ whereupon a wave induction occurs which propagates in waveguide 64 with the gain of the induced RF signal increasing as it propagates.

In order to provide a better understanding of the invention, consider an induced RF wave propagating in waveguide 64 of phase velocity $V_p$ traversing a slot $52_i$ of width equal to or less than $\lambda/2$, where $\lambda$ is the wavelength of the waveguide mode. It will take the RF wave a time $t_r=\lambda/2V_p$ to traverse the slot. The respective electron beam $e_i$, in approximately the same time period, must travel from grid $50_i$ to slot $52_i$ a distance l in the time $t_e$. On the average, $t_r \cong t_e$ or $2V_p/\lambda=u_o/l$, where $u_o$ is the DC electron drift velocity and l is the grid to slot spacing. Typically, $V_p=C/10$ where C is the velocity of light. Accordingly, $u_o=lC/5\lambda=2lC/\lambda_0$ where $\lambda_0$ is the free space wavelength. If l is said to be equal $\cong\lambda_0/10$ then $u_o/C=1/5$ and $v \approx 10$ kv, where $v$ is the beam voltage. Under such set of conditions, a 10 kv beam traveling a distance of $\lambda_0/10$ from grid to slot would be in synchronism with an RF wave propagating from left to right in a waveguide structure shown in FIGS. 2 and 3 at a phase velocity of 1/10 C.

Furthermore, for operating frequencies where the gap dimensions, i.e. the slot width, are small compared to wavelength, one can consider the gaps as lumped capacitors. In such a case, the ratio of reverse power to forward power can be expressed as:

$$\frac{P_R}{P_F} = \left[\frac{\sin(N_B\phi)}{N_B\sin\phi}\right]^2 \tag{1}$$

where $N_b$ is the number of beams in the beam build-up section, and $\phi$ is the phase delay of the gap. The output impedance $Z_e$ can be expressed as:

$$Z_e = \frac{2Z_B}{N_B + 2N_p} \tag{2}$$

where $Z_B$ is the beam impedance and $N_p$ is the number of beams in the beam power section. The $\omega$- B characteristic and characteristic impedance Z can be determined from the following equation:

$$\cos(BD) = \cos(B_OD) - \frac{SZ_O}{2}\sin(B_OD) \tag{3}$$

Accordingly, $$Z = Z_O\frac{\sin(B_OD)}{\sin(BD)} \tag{4}$$

where B, $B_0$, Z, $Z_0$ are the propagation constants and characteristic impedances of the loaded and unloaded lines respectively, S is the shunt susceptance of the interaction gap, and D is the periodic spacing of the gap. A condition for efficient power extraction from a beam $e_i$ is $1<V/V_0<1.5$ where $V=I_RZ_L$ and where $I_R$ is the current beyond the beam build-up section toward the load and $Z_L$ is the characteristic impedance of the guide and $V_0$ is the RF voltage of the forward wave beyond the beam build-up section.

Figure 6:
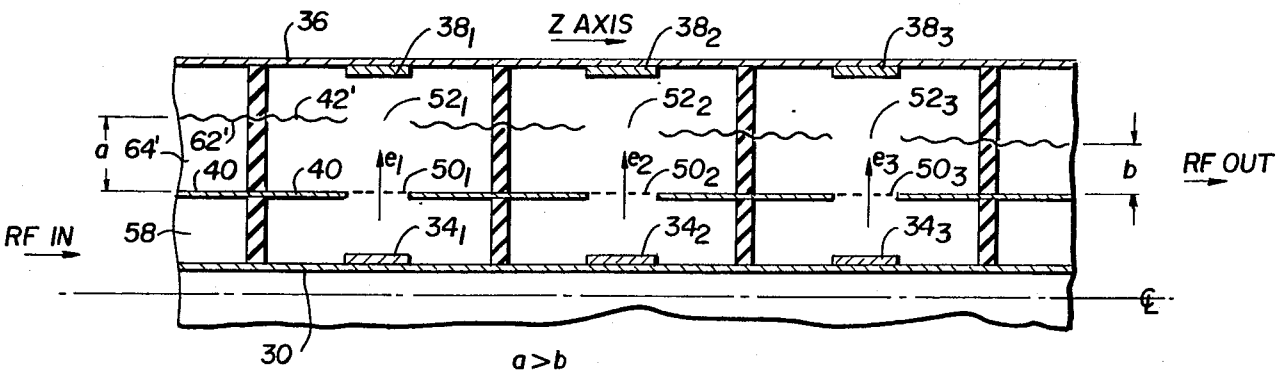
FIG. 6 is a partial half-central longitudinal sectional view of a modification of the embodiment shown in FIG. 3.

The embodiment of the subject invention shown in FIGS. 2 and 3 comprises but one illustrative embodiment of the invention. A modification of the two waveguide configuration (FIG. 3) is shown in FIG. 6 and is essentially identical to the structure disclosed in FIGS. 2 and 3 with the exception that the output waveguide 64' is now comprised of an inclined slow wave cylinder structure 42 which provides a width taper between the waveguide walls 40 and 62' which diminishes in the direction of propagation as indicated by the dimension (a) at the left or input side, and (b) at the right or output side. Such a configuration operates to successively lower the impedance from left to right for purposes of avoiding reflected waves in the output waveguide 64'.

At the risk of complicating the focusing problem, further gain and efficiency can be achieved by increasing the number of rippled or undulating waveguide cylinders. The embodiment shown partially in FIG. 7, for example, comprises a three waveguide system including two slow wave structures in the form of two rippled surface cylinders $42_a$ and $42_b$ defining a pair of adjacent circular waveguides $64_a$ and $64_b$. Whereas in the early embodiments, the RF input wave was applied to the inner waveguide 58 defined by surfaces of cylinders 30 and 40, in the present instance, however, the RF input wave is applied to the waveguide $64_a$ defined by the opposing surfaces of the cylindrical waveguide 40 including the grids $50_1 \ldots 50_n$ and the first rippled waveguide cylinder $42_a$. The induced RF wave accordingly is formed in the outer adjacent waveguide $64_b$ defined by the opposing rippled walls of the rippled wall cylinders $42_a$ and $42_b$. Furthermore, a separation taper is defined by the dimensions (a) and (b) and is provided between the corrugated cylindrical waveguide cylinders $42_a$ and $42_b$ in a manner similar to the embodiment shown in FIG. 6 and which has for its purpose the prevention of reflected wave generation in the output grids $64_b$. In order to operate such a configuration with as few bias potentials as possible, the rippled waveguide cylinders $42_a$ and $42_b$ are connected to ground potential and the DC supply potentials $V_g$, $V_w$ and $V_c$ are reversed in polarity with respect to that shown in FIG. 3.

Figures 7, 8, 9:
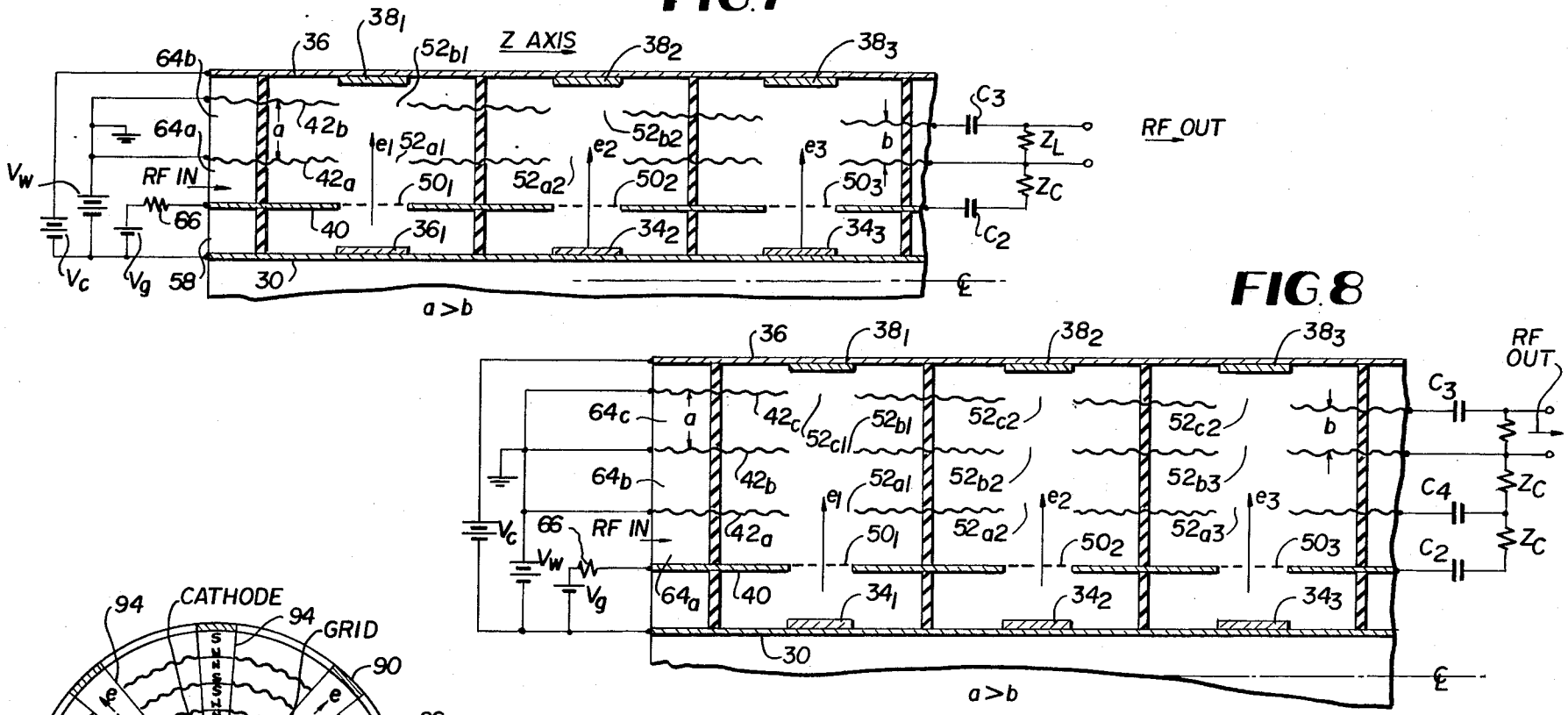
FIG. 7 is a partial half-central longitudinal view of another embodiment of the invention similar to that shown in FIG. 6.
FIG. 8 is a partial half-central longitudinal sectional view of yet another embodiment of the invention.
FIG. 9 is a transverse sectional view illustrative of an alternative embodiment of the invention.

A four waveguide version of the invention is shown in FIG. 8 where there is included three rippled wall cylindrical waveguide members $42_a$, $42_b$, $42_c$ located between the inner cylindrical member 40 containing the grids $50_1$, $50_2$ . . . $50_n$ and the outermost cylinder 36 which in addition to providing a housing structure, supports the annular collectors $38_1$ . . . $38_n$. As configured, each electron beam $e_i$ traverses three accelerator slots $52_{a1}$, $52_{b1}$ and $52_{c1}$. Further as shown, the RF input wave is injected at the left side of the circular waveguide $64_a$ defined by the inner surfaces of cylinders 40 and $42_a$ while the output waveguide comprises the waveguide $64_c$ defined by the opposing surfaces of the rippled cylindrical members $42_b$ and $42_c$. Furthermore, a space taper is provided in the waveguide $64_c$ by decreasing the separation from left to right as indicated by the dimensions (a) and (b). The biasing arrangement is the same as shown with respect to the embodiment of FIG. 7; however, since another waveguide element exists, a second terminating impedance $Z_c$ is required along with a blocking capacitor $C_4$ connected between the waveguide elements $42_a$ and $42_b$.

While the figures portray the various electrodes as having flat surfaces with abrupt edges, in reality one practicing the invention should shape the grid and collector electrodes to achieve improved beam transmission. Also, the slot geometry should be appropriately tailored. Further, where operation is desired at millimeter wave frequencies, the relative size of the structure would complicate the construction because the device would become relatively miniature in size. The lowest order mode of operation is a TEM mode and the electric fields are radial outward or inward at a given instant of time. Thus the E fields are also in the same or opposite direction of electron flow at a given time. Furthermore, for operation of the subject invention at millimeter wave frequencies, one could operate in a higher order TEM mode.

While the foregoing embodiments have been described with respect to a generally annular cylindrical configuration; however, one could when desired, fashion the multibeam interaction amplifier of the subject invention into a flat pancake type of structure where the waveguide sections instead of extending linearly would be curved into a circle as shown in FIG. 9. Considering now briefly FIG. 9, a circular member 70 contains a plurality of equally spaced cathodes 72 arranged around its perimeter. Although not shown, heater means for each of the cathodes 72 is provided inwardly of the circular member 70 and preferably comprise individual heaters. When desirable, however, a single heater element may be employed. Adjacent the circular element 70 containing the cathodes is a second circular element 74 which includes an equal number of grids 76. Further as shown, three contiguous waveguide sections 78, 80 and 82 encircle the cathode and grids and have appropriate slots 84, 86 and 88 for the passage of respective electron beams e to respective collector segments 90 located in an outer circular support member 92.

In such an arrangement, the cathode-collector structure in the intermediate electrodes becomes segmented rather than annular configurations as previously described, but in operation, where an input wave, for example, is applied to waveguide 78, an amplified RF output wave would be taken from waveguide 82. In order to provide proper focusing, a plurality of permanent magnets arranged in a spoke geometry as indicated by reference numeral 94 and situated over the electron beam paths e as shown, would provide the correct and proper magnetic focusing field. It should also be pointed out that with respect to the radial configuration of FIG. 9, the distance between slots would be longer for the waveguides located at a larger radial distance from the cathode. Thus in order to keep the guide propagation constant the same in all waveguides, one must increase the RF wave velocity for each waveguide further out on the radius in relation to the inner most waveguide. This can be accomplished by decreasing the dielectric loading from inner to outer waveguides and tailoring the wall surfaces with an appropriate ripple. Furthermore, the RF input and output connections can be made by right coupled waveguide bends, not shown, which would arrange the RF input and output coupling perpendicular to the plane of the electron beam flow. One notable advantage of the configuration shown in FIG. 9 is that the collectors are located on the outermost circumference and accordingly would have relatively larger surface areas so that the heat dissipation capability would be increased.

Having thus shown and described what is at present considered to be the preferred embodiments of the invention, it should be noted that the same has been made by way of illustration and not limitation. Accordingly, all modifications, alterations and changes coming within the spirit and scope of the invention as set forth in the appended claims are herein meant to be included.

We claim:

1. A transverse field interaction device, comprising:

an inner coaxial cathode structure including a plurality of discrete radially disposed electron emitting cathode electrodes for emitting a plurality of radial electron beams;

an outer coaxial electron collector structure including a like plurality of discrete radially disposed electron collector electrodes located outwardly from and aligned with said cathode electrodes; a coaxial grid structure including a like plurality of radially disposed grid electrodes located intermediate and aligned with said cathode and collector electrodes;

a coaxial slow wave propagation and electron acceleration structure between said grid and collector electrodes including respective radially disposed apertures for the passage of electrons from each of said cathodes to respective collector electrodes;

first RF signal propagation means including at least said grid electrodes for propagating an input RF wave transversely relative to electron emission from said cathode electrodes for modulating and thereby prebunching said electron beams; and second RF signal propagation means including at least said slow wave propagation structure for propagating an induced amplified RF output wave in the same direction as said input wave and resulting from said prebunched electron beams traversing respective apertures in said slow wave structure.

2. The device as defined by claim 1 wherein said first signal propagation means also includes said cathode electrodes and said second signal propagation means also includes said grid electrodes.

3. The device as defined by claim 1 wherein said device includes a coaxial longitudinally extending cylindrical structure, and wherein said plurality of cathode electrodes include a first inner cylindrical member having a plurality of discrete annular cathode elements located on and disposed along the length thereof, wherein said collector electrodes include a second outer cylindrical member having a plurality of annular collector elements located on and along the length of the inside surface thereof, wherein said grid electrodes include a third cylindrical member having a plurality of discrete annular grids on and along the length thereof intermediate said cathode and collector electrodes, wherein said slow wave propagation structure includes a fourth cylindrical member located intermediate said second and third cylindrical members and having a slow wave propagation surface including said respective apertures therein, said surface being oriented toward said third cylindrical member, and wherein said first signal propagation means includes mutually opposing surfaces of a first inner pair of said cylindrical members and said second signal propagation means includes mutually opposing surfaces of a second outer pair of said cylindrical members.

4. The device as defined by claim 3 wherein said first pair of cylindrical members includes said first and third cylindrical members and said second pair of cylindrical members includes said third and fourth cylindrical members.

5. The device as defined by claim 3 wherein said respective apertures of said slow wave structure include annular slots in said fourth cylindrical member in registration with said annular grids.

6. The device as defined by claim 3 and additionally including cathode heater means located inside of said first cylindrical member, direct voltage bias and acceleration means connected between said cylindrical members for causing electron emission from said cathode electrodes to pass through said grid electrodes and apertures in said slow wave structure to be collected by said collector electrodes, and means for coupling RF signals into one end of said coaxial sturcture and for coupling RF signals out from the other end thereof.

7. The device as defined by claim 3 wherein said fourth cylindrical member has inner and outer cylindrical surfaces both of which include a rippled configuration providing thereby said slow wave propagation means.

8. The device as defined by claim 3 and additionally including a fifth cylindrical member located outwardly of and adjacent said fourth cylindrical member and having apertures in the form of annular slots therein and a slow wave propagation surface in the form of a rippled surface facing said fourth cylindrical member.

9. The device as defined by claim 8 wherein the separation between said fourth and fifth cylindrical members is selectively varied to prevent RF wave reflection from one end.

10. The device as defined by claim 9 wherein the separation between said fourth and fifth cylindrical members is reduced in the direction of signal propagation.

11. The device as defined by claim 8 wherein said first pair of cylindrical members includes said third and fourth cylindrical members and said second pair of cylindrical members includes said fourth and fifth cylindrical members.

12. The device as defined by claim 8 and additionally including a sixth cylindrical member located outwardly of and adjacent said fifth cylindrical member and having apertures in the form of annular slots therein, and a slow wave propagation surface in the form of a rippled surface facing said fifth cylindrical member.

13. The device as defined by claim 12 wherein the separation between said fifth and sixth cylindrical members is reduced in the direction of signal propagation.

14. The device as defined by claim 13 wherein said first pair of cylindrical members includes said third and fourth cylindrical members and said second pair of cylindrical members includes said fifth and sixth cylindrical members.

15. The device as defined by claim 1 wherein said plurality of cathode electrodes are arranged in a first generally circular configuration and further including cathode heater means located within and adjacent said first circular configuration, wherein said collector electrodes are arranged in a second generally circular configuration outwardly disposed relative to said first circular configuration, wherein said plurality of grid electrodes are arranged in a third generally circular configuration located intermediate said first and second circular configurations, and wherein said a slow wave structure is arranged in a fourth generally circular configuration located between said grid electrodes and said collector electrodes and having a like plurality of apertures in substantial registration with said cathode, grid, and collector electrodes, wherein said first signal propagation means comprises mutually opposing surfaces of a first pair of circular configurations, and wherein said second signal propagation means comprises mutually opposing surfaces of a second pair of circular configurations.

16. The device as defined by claim 15 wherein said first and second pairs of circular configurations include portions of curvilinear waveguide means.

17. The device of claim 16 wherein one arcuate portion of said curvilinear waveguide means includes a rippled wall for forming a slow wave RF transmission line structure.

18. The device of claim 15 wherein said slow wave structure includes a plurality of contiguous curvilinear waveguide elements in the form of a rippled waveguide wall and having like pluralities of apertures in the form of slots in substantial registration with said cathode, grid, and collector electrodes.

19. The device of claim 18 and wherein said first pair of circular configurations comprises a pair of inner waveguide elements and said second pair of circular configurations comprises a pair of outer waveguide elements.

* * * * *